United States Patent [19]

Litch

[11] 4,120,438

[45] Oct. 17, 1978

[54] NAIL DRIVER

[76] Inventor: Ivan J. Litch, 21611 Locust Way, Lynnwood, Wash. 98036

[21] Appl. No.: 774,598

[22] Filed: Mar. 7, 1977

[51] Int. Cl.[2] ..... B25C 1/02

[52] U.S. Cl. ..... 227/147

[58] Field of Search ..... 227/146, 147

[56] References Cited

U.S. PATENT DOCUMENTS

| | | | |
|---|---|---|---|
| 329,278 | 10/1885 | Copeland | 227/147 |
| 510,467 | 12/1893 | Boeklen | 227/147 |
| 1,289,526 | 12/1918 | Nye | 227/147 |
| 2,475,936 | 7/1949 | Allen | 227/147 |
| 2,767,399 | 10/1956 | Widener | 227/146 |

*Primary Examiner*—Granville Y. Custer, Jr.
*Attorney, Agent, or Firm*—Seed, Berry, Vernon & Baynham

[57] ABSTRACT

An apparatus for driving a nail into a relatively inaccessible surface. The nail driver includes an elongated cylindrical housing having a bore extending between its front and rear ends, the rear end covered by an end cap. A rigid rod of lesser diameter than the bore of the housing is slidably received in the bore, with the rear end of the rod projecting rearwardly through the end cap when the front end of the rod is adjacent the front end of the housing. The rear end of the rod carries a weighted handle. The front end of the rod includes a magnetized end portion of about the same diameter as the bore of the housing. A first compression spring extends between the end cap and the weighted handle to absorb the momentum of the weighted handle at the forward end of a stroke, and a second compression spring surrounds the rod within the housing and extends between the end cap and the end portion of the rod for resiliently biasing the rod in a forward direction.

1 Claim, 3 Drawing Figures

NAIL DRIVER

BACKGROUND OF THE INVENTION

1. Field of the Invention

This invention relates to an impact tool, and more particularly to an apparatus for driving a nail into relatively inaccessible surfaces.

2. Description of the Prior Art

A conventional hammer is normally used to drive a nail into a surface. However, in certain applications, such as when the surface to be nailed is surrounded by walls or barriers which are spaced sufficiently close together to prevent the placement of the hand of the person hammering therebetween, it is difficult, if not impossible, to utilize a conventional hammer for nail driving.

One prior art device utilized for driving nails into ceilings is described in U.S. Pat. No. 2,767,399 issued to Widener.

SUMMARY OF THE INVENTION

The primary object of this invention is to provide a relatively inexpensive and reliable apparatus for driving nails into a relatively inaccessible surface.

Another object of this invention is to provide a nail driver which can be used to drive a wide variety of nails, from carpet tacks to 16-penny nails.

This and other objects of the invention are accomplished by a nail driver having a rigid rod surrounded by a tubular housing. A weighted handle is secured to the rear end of the rod so that a nail inserted into the front end of the housing with the head of the nail facing rearwardly may be driven into a surface by placing the front end of the housing against the surface, withdrawing the handle rearwardly and then manually hurling the handle forwardly toward the surface so that the momentum of the handle and the force of the nailer's arm drives the nail into the surface. The front end of the rod may be magnetized so that the nail moves with the rod. The rear end of the housing is preferably closed by an end cap. A first compression spring extends between the end cap and the weighted handle to absorb the impact of the handle at the forward end of the stroke, as the head of the nail contacts the surface. A second compression spring surrounds the rod within the housing and extends between the end cap and an end portion of the rod for resiliently biasing the rod in a forward direction.

DETAILED DESCRIPTION OF THE INVENTION

Figure 1:
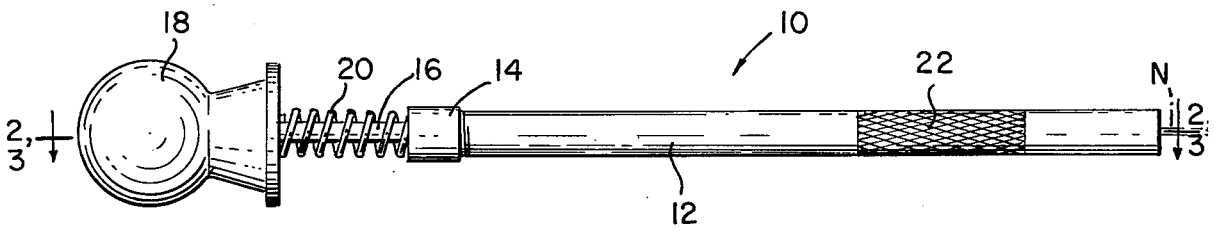
FIG. 1 is a side elevational view of the inventive nail driver.

The external features of the inventive nail driver 10, as illustrated in FIG. 1, include a tubular housing 12 having a length selected according to the optimum length for a given application. The rear end of the housing 12 is externally threaded, and an end cap 14 is threaded onto the rear end of the housing 12. A rigid rod 16 of lesser diameter than the internal diameter of the housing projects rearwardly from the housing 12 through a central aperture in the end cap 14 of the same diameter as the outer diameter of the rod and carries a weighted handle 18. The mass of the weighted handle 18 will depend upon the particular application which the nail driver is used and will be affected by such factors as the hardness of the surface into which the nail is driven as well as the size of the nail. A compression spring 20 extends between but is not attached to either the end cap 14 or the handle 18 for absorbing the impact of the weighted handle 18 at the forward end of each stroke thereof, as described hereinafter. The outer surface of the tubular housing 12 toward the front end contains a knurled band 22 allowing the handle 12 to be more securely held by the user. The nail N which is inserted into a wall surface S or another surface projects forwardly from the front end of the housing 12 with the pointed end facing forwardly.

Figure 2:
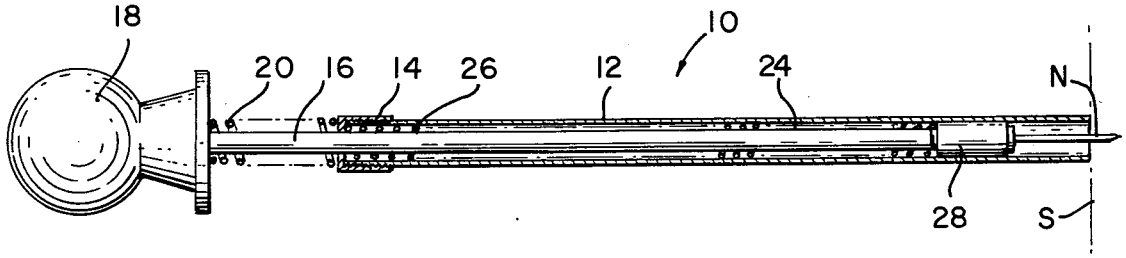
FIG. 2 is a cross-sectional view taken along the line 2—2 of FIG. 1 illustrating the driving rod at the forward end of a stroke with the nail partially inserted into a surface.

The internal structure of the nail driver 10 is best illustrated in FIG. 2. A constant bore 24 extends along the length of the housing 12. The rod 16 includes an end portion 28 having an outer diameter about the same as the inner diameter of the bore. The end portion 28 is preferably magnetized and is either welded or threaded to the end of rod 16. The space between the rod 16 and inner wall of the housing 12 accommodates a second compression spring 26 surrounding the rod 16 and extending between the end cap 14 and end portion 28 secured to the rod 16. The compression spring 26 has an inside diameter slightly larger than the diameter of the rod 16, and an outside diameter slightly smaller than the inside diameter of the housing 12. The aperture in the end cap and the end portion 28 acts as guides to center the rod 16 with respect to the bore 24 to maintain the rod 16 along the axis of the bore 24. The compression spring 26 has a relatively light spring constant so that it exerts a relatively insignificant force on the rod in a forward direction sufficient to bias the rod in a forward direction and prevent it from moving freely within the bore 24. As mentioned the end portion 28 of the rod 16 is magnetized so that the head of the nail is magnetically secured thereto.

In operation the nail N is inserted through the forward end of the housing 12 with the head of the nail N resting against the magnetized end portion 28 of the rod 16. The weighted handle 18 is withdrawn rearwardly to draw the nail N into the housing 12 to allow the front end of the housing 12 to be placed against the surface S into which the nail is to be driven. The weighted handle 18 is then withdrawn rearwardly away from the surface S to compress the spring 26 between the end cap 14 and end portion 28. The weighted handle 18 is then manually hurled forward toward the surface S by the hand of a person so that the momentum of the handle 18 drives the nail N into the surface S. It is important to note, unlike prior art nail driving devices, the nail driver does not depend upon the strength of the spring 26 for providing the weighted handle 18 with a momentum, but instead the momentum is provided directly by the user. It will generally be necessary to repetitively withdraw the weighted handle 18 rearwardly away from the surface S and then hurl the weighted handle 18 toward the surface S in order to completely drive the nail N into the surface S. The number of such repetitions will, of course, depend upon such variables as the size of the nail, the characteristics of the surface, the weight of the weighted handle 18, and the physical strength of the user.

Figure 3:
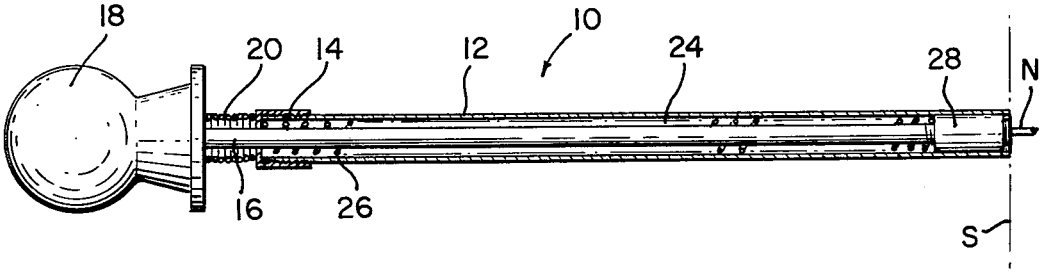
FIG. 3 is a cross-sectional view taken along the line 3—3 of FIG. 1 illustrating the driving rod at the forward end of the final stroke with the nail driven all of the way into the surface.

When the rod 16 is at the forward end of an intermediate stroke such as illustrated in FIG. 2 the compression spring 20 is in its undeformed condition so that the entire momentum of the weighted handle 18 is imparted to the nail N. However, during the final strokes when the nail N has been almost completely driven into the surface S, the spring 20 will begin to compress thereby absorbing part of the momentum of the weighted handle 18. At the forward end of the final driving stroke as illustrated in FIG. 3, the spring 20 is almost completely compressed, thereby preventing the rod 16 from driving the nail N too deeply into the surface S. Consequently, the compression spring 20 does not affect the operation of the nail driver during the major portion of the nail driving operation, but it does absorb a portion of the handle's impact toward the end of the operation.

The apparatus, by utilizing a few relatively simple elements, provides a relatively inexpensive and reliable means for driving a nail into an inaccessible surface.

I claim:

1. An apparatus for driving a nail into a surface comprising:

an open-ended tubular housing having an internal bore therein, a forward end which contacts over its entire surface the surface into which the nail is to be driven and a rear end, an end cap having an aperture therein with a diameter smaller than the diameter of the internal bore of the housing and closing the rear end of the housing, a rod having a diameter approximating the diameter of the aperture in the end cap and having a length greater than the length of the tubular housing received in the internal bore, the rod having a rear end projecting from the bore at the rear end of the housing through the aperture in the end cap and a forward end secured to a magnetic rod portion having a diameter approximating the diameter of the internal bore of the housing, the aperture in the end cap and the magnetic rod aligning the rod within the internal bore of the housing, a weighted handle secured to the rear end of the rod, a first compression spring surrounding the rod and extending between the weighted handle and the end cap to absorb the momentum of the weighted handle at the forward end of a driving stroke and to cushion the forward movement of the rod with respect to the housing, and a second compression spring having a relatively low spring constant mounted within the tubular housing and extending between the magnetic rod portion and the end cap for resiliently biasing the rod in a forward direction but not providing the rod with sufficient momentum to drive a nail, the apparatus used by inserting a nail in the bore at the forward end of the housing with the head of the nail magnetically secured to the magnetic rod portion and driving the nail into the surface by placing the forward end of the housing against the surface and repetitively withdrawing the weighted handle and hurling the weighted handle toward the surface.

* * * * *